US006187498B1

(12) United States Patent
Knapp et al.

(10) Patent No.: US 6,187,498 B1
(45) Date of Patent: Feb. 13, 2001

(54) LIQUID DEVELOPERS AND PROCESSES THEREOF

(75) Inventors: Christopher M. Knapp; George A. Gibson, both of Fairport; David H. Pan, Rochester; John W. Spiewak, Webster, all of NY (US)

(73) Assignee: Xerox Corporation, Stamford, CT (US)

( * ) Notice: Under 35 U.S.C. 154(b), the term of this patent shall be extended for 0 days.

(21) Appl. No.: 09/502,342

(22) Filed: Feb. 10, 2000

Related U.S. Application Data

(62) Division of application No. 09/385,526, filed on Aug. 30, 1999, now Pat. No. 6,060,204.

(51) Int. Cl.[7] ..... G03G 9/13
(52) U.S. Cl. ..... 430/115
(58) Field of Search ..... 430/115

(56) References Cited

U.S. PATENT DOCUMENTS 4,507,377 * 3/1985 Alexandrovich ..... 430/115
5,300,390 * 4/1994 Landa et al. ..... 430/115
5,759,733 * 6/1998 Tsubuko et al. ..... 430/115
5,989,769 * 11/1999 Mosher et al. ..... 430/115

* cited by examiner

*Primary Examiner*—Roland Martin
(74) *Attorney, Agent, or Firm*—John L. Haack

(57) ABSTRACT

A process including:

forming a first image on a first substrate with a liquid toner comprising a resin, a colorant, a carrier liquid, and an adhesion promoting compound;

transferring the image from the first substrate to a second substrate;

overcoating the image on the second substrate with a transparent overcoat layer, and treating the resulting overcoated image.

7 Claims, No Drawings

LIQUID DEVELOPERS AND PROCESSES THEREOF

This application is a divisional of application Ser. No. 09/385,526, filed Aug. 30, 1999, now U.S. Pat. No. 6,060,204.

REFERENCE TO COPENDING APPLICATIONS

Attention is directed to commonly owned and assigned U.S. application Ser. No. 08/963,360 filed Nov. 3, 1997, now abandoned, entitled "Method and Apparatus for Liquid Developing Material Based Latent Image Development"; and U.S. application Ser. No. 09/182,786 (D/97685) filed Nov. 30, 1998, now U.S. Pat. No. 5,989,769, entitled "Liquid Developers and Processes Thereof," which discloses a liquid developer composition comprising: a resin, a colorant, a liquid carrier vehicle, and a cake inducing agent.

The disclosure of the above mentioned copending application are incorporated herein by reference in its entirety. The appropriate components and processes of the disclosure may be selected for the inks and processes of the present invention in embodiments thereof.

BACKGROUND OF THE INVENTION

The present invention is generally directed to liquid toner and developer compositions and to imaging processes thereof. More specifically, the present invention relates to improved liquid developer compositions and improved development and imaging processes thereof arising from, for example, including an adhesion promoting compound in the liquid developer.

A significant problem associated with prior art liquid developers, particularly liquid developers that are subsequently laminated is delamination or poor adhesion of the laminate or overcoat to the ink image and to the substrate. The problem is particularly pronounced for laminated images which experience high or variable humidity, and related extreme environmental and temperature fluctuations. Total or partial delamination typically results in deterioration or destruction of the image quality thereby rendering the image incomprehensible and unacceptable from an aesthetic appeal perspective. The foregoing delamination and image degradation problems are particularly acute where the laminate overcoat layer employs a vinyl acrylic adhesive. These and other lamination and image defect problems are solved in embodiments of the present invention.

PRIOR ART

In U.S. Pat. No. 5,842,097, issued Nov. 24, 1998, to Kanbayashi, et al., there is disclosed an image forming method, including the steps of: forming a toner image with a toner having toner particles and an external additive on a surface of a first image-carrying member which includes a support and a lamination layer disposed thereon containing a peeling layer, fixing the toner image on the surface of the peeling layer of the first image-carrying member to form a fixed image, peeling the peeling layer having the fixed image from the first image-carrying member, and transferring the fixed image on the peeling layer onto a second image-carrying member while swelling the peeling layer, wherein the lamination layer has at least the peeling layer and an adhesive layer, the peeling layer at least including a transfer layer and having an area expansion ratio of 102–106%. The transfer layer may preferably be a composition containing a high-saponified polyvinyl alcohol having a saponification degree of at least 90% and a low-saponified polyvinyl alcohol having a saponification degree of below 90%. The binder resin may preferably be polyester resin having an acid value of 2–25 mg KOH/g. The peeling layer having an appropriate area expansion ratio (102–106%, preferably 102–105%) is effective in allowing quick and uniform peeling thereof from the fixed image.

In U.S. Pat. No. 5,725,935, issued Mar. 10, 1998, to Rajan, there is disclosed signage articles having a layer of fused dry toner powder which is fused by employing a tacky pressure-sensitive adhesive and low compression. Suitable tacky pressure-sensitive adhesives include alkyl acrylate polymers or copolymers, alkyl vinyl ether polymers or copolymers, polyisobutylene, polybutadiene, and butadiene-styrene copolymers. Such signage articles further comprise a transparent cover layer disposed over the fused dry toner powder-bearing surface. Also disclosed are methods of forming signage articles, one method comprising the steps of applying dry toner powder to a first substrate surface, applying a composition including a tacky pressure-sensitive adhesive to a second substrate surface, and laminating the two substrates to admix the dry toner powder and the tacky pressure-sensitive adhesive. Either the first or second substrate may be the transparent cover layer of the resulting signage article.

In U.S. Pat. No. 5,655,192, issued Aug. 5, 1997, to Denton et al., there is disclosed a method and apparatus for compaction of a liquid ink developed image in a liquid ink type multicolor electrostatographic printing machine of the type utilizing liquid developing material, particularly an image-on-image type liquid ink multicolor system. The image compacting apparatus includes a biased electrode situated proximate to the image on an image bearing surface, and a liquid applicator for depositing liquid insulating material in a conditioning gap defined by the electrode and the image bearing surface. A high electric potential is applied to the electrode for generating a large electric field in the gap to electrostatically compress toner particles into image areas on the image-bearing surface. The liquid insulating material is deposited into the conditioning gap for avoiding the risk of air breakdown as may occur in an electrostatic device of this nature due to the small geometry of the apparatus and the tendency of air ionization in an air gap between electrically biased surfaces. Preferably, the liquid insulating material is the very same material utilized as the liquid carrier component of the liquid developing material.

Liquid developer and related compositions and processes for their preparation are known, reference for example, U.S. Pat. Nos. 5,563,015, 5,565,299, 5,567,564, 5,382,492, 5,714,993, 5,570,173, and 5,612,777. The disclosures of the aforementioned patents are incorporated herein by reference in their entirety.

There remains a need for liquid electrostatic toner and developer compositions and processes thereof which provide high quality and high resolution developed images over the entire range of known development and printing speeds, and for highly robust and environmentally stable laminated images prepared from the developed images.

The developers and development processes thereof of the present invention are useful in many applications, including toners for use in electrophotographic imaging processes, such as digital printing and copying systems including color systems, and for use for example, in liquid marking, such as liquid electrostatic printing, ink jet printing applications, and offset printing inks and applications.

SUMMARY OF THE INVENTION

Embodiments of the present invention, include:

A process comprising:

forming a first image on a first substrate with a liquid toner comprising a resin, a colorant, a carrier liquid, and an adhesion promoting compound;

transferring the image from the first substrate to a second substrate;

overcoating the image on the second substrate with a transparent overcoat layer, and treating the resulting overcoated image;

A liquid toner comprising: a first resin, a second adhesion promoting resin, a colorant, and a carrier liquid; and A printing machine comprising:

a liquid developer image forming device adapted for forming images on a first substrate;

a second substrate adapted for receiving the image from the first substrate;

a coater adapted for overcoating the resulting image on the second substrate; and a heater adapted to thermally activate an adhesion promoting compound contained in the liquid developer thereby substantially permanently affixing the image or images and overcoat to the second substrate.

These and other embodiments of the present invention are illustrated herein.

DETAILED DESCRIPTION OF THE INVENTION

The developers and development processes of the present invention provide a simple and effective solution to the problem of delamination or poor lamination stability encountered, for example, in liquid ink development printing systems which employ conventional liquid electrostatic toner or ink developer formulations.

Although not wanting to be limited by theory it is believed that the vinyl acrylic adhesive component or other formulation ingredients of the laminate may exacerbate the delamination and image distortion problems by, for example, plasticizing the toner image layer(s) and thereby vitiate adhesive and cohesive attractive forces associated with the toner resin and which forces act on the substrate, the laminate overcoat, and any adjacent toner layers, for example, images provided by "image-on-image" type development processes.

Thus the present invention in embodiments provides a process comprising:

forming a first image on a first substrate with a liquid toner comprising a resin, a colorant, a carrier liquid, and an adhesion promoting compound;

transferring the image from the first substrate to a second substrate;

overcoating the image on the second substrate with a transparent overcoat layer, and treating the resulting overcoated image.

The adhesion promoting compound is believed to afford improved adhesion of the image to the second substrate, and improved adhesion of the image to the transparent overcoat layer. An important net effect of the improved adhesion and cohesion properties is to provide superior and unexpected laminate stability and image stability and quality.

The present invention in embodiments can further comprise forming at least one second image on the first image to form a layered toner image wherein the adhesion promoting compound affords improved cohesion of the layered toner image, for example as frequently encountered in the aforementioned image-on-image development processes.

The transparent overcoat can, if desired, further comprise a solvent based acrylic adhesive. Solvent based acrylic adhesives are known and preferred although other alternative adhesives can also be used successfully in the present process, for example, pressure sensitive adhesives and the like adhesives materials. A wide range of suitable adhesive materials and formulations are commercially available, for example, from 3M Corp., Loctite Corp., and Rohm and Haas.

The adhesion of the overcoated image to the second substrate can be enhanced by the inclusion of the adhesion promoting compound in the liquid toner formulation. The adhesion can be improved in an amount of from about 5 to about 50 percent compared to the same image formed without the adhesion promoting compound present in the liquid toner.

The treating or treatment of the resulting overcoated image is designed to activate the adhesion promoting compound so that, for example, toner-toner cohesion is increased in an amount of from about 15 to about 55 percent and toner-overcoat adhesion is increased in an amount of from about 5 to about 50 percent compared to the same image formed without the adhesion promoting compound present in the liquid toner. The treatment of the overcoated image can be accomplished with, for example, heat, light, pressure, and the like physical forces, or combinations thereof.

The adhesion promoting compound can be a thermally activated polymer composition selected from the group consisting of epoxy-modified ethylene vinyl acetate polymers, anhydride-modified ethylene vinyl acetate polymers, ethylene methacrylic acid copolymers, ethylene acrylic acid copolymers, ethylene-vinyl acetate-methacrylic acid terpolymers, copolymers thereof, and mixtures thereof, present in an amount of from about 1.0 to about 35.0 weight percent based on the total solids content of the liquid toner.

A preferred adhesion promoting compound is an ethylene-vinyl acetate-maleic anhydride terpolymer, for example, BYNEL E418™, commercially available from Du Pont.

The transparent overcoat can be any known substantially transparent polymer composition such as of vinyl acetate, poly(vinyl chloride), polyesters, known modified cellulosics, reference for example, U.S. Pat. No. 5,925,595, the disclosure of which is incorporated by reference herein in its entirety, such as alkylated derivatives such as methyl-, ethyl-, and ethyl hydroxyethyl-cellulose, and the like materials, and acylated cellulose derivatives, for example cellulose acetate, cellulose benzoate, and the like materials, polycarbonates, polyamides, and mixtures thereof, which provides overcoat laminate properties and image protection.

The first and second substrates can be, for example, paper, transparency materials, plastics, polymeric films, metals, treated cellulosics, wood, metals, and mixtures thereof.

In embodiments, the present invention provides a liquid toner comprising: a first resin, a second adhesion promoting resin, a colorant, and a carrier liquid. The second adhesion promoting resin promotes the adhesion of developed toner images to: the substrate; to an overcoating layer; and to adjacent toner layers.

The second adhesion promoting resin can be a thermally activated polymer composition such as epoxy-modified ethylene vinyl acetate copolymers, anhydride-modified ethylene vinyl acetate copolymers, ethylene methacrylic acid copolymers, ethylene acrylic acid copolymers, ethylene-vinyl acetate-methacrylic acid terpolymers, copolymers thereof, and the like polymeric materials, and mixtures thereof.

The first resin a conventional liquid toner resin and can be present in a major amount of, for example, from about 5 to about 80 weight percent, and wherein the second adhesion promoting resin can be present in a minor amount of, for example, from about 1.0 to about 35 weight percent based on the total solids content of the liquid toner. The first resin can be any conventional liquid toner resin such as acrylates, styrenes, polyesters, polyolefins and mixed polyolefins such as ethylene-propylene copolymers, mixed copolymers such as poly(ethylene-vinyl acetate), poly(ethylene-methacrylic acid), poly(ethylene-acrylic acid), and the like materials, and mixtures thereof.

The colorant can be, for example, known pigments, dyes, and mixtures thereof. The colorant can be one or more pigments, one or more dyes, and mixtures thereof. The colorant can be a pigment, for example, carbon black, magnetite, cyan, yellow, magenta, red, green, blue, brown, orange, and the like, and mixtures thereof.

The carrier liquid can be, for example, known linear hydrocarbons with from 10 to about 40 carbon atoms, branched hydrocarbons with from 10 to about 40 carbon atoms, and mixtures thereof, such as hydrocarbons NOR-PAR® 15 or ISOPAR® L commercially available from Exxon Corp., in an amount of about 80 to about 99.5 weight percent of the total weight of the composition.

The liquid developer can further comprise optional additives such as charge directing compounds, such as aluminum stearate or aluminum complex salts, charge enhancing additives, such as lecithin or quaternary ammonium substituted block copolymer prepared by group transfer polymerization, in an amount of about 0.1 to about 5.0 weight percent of the solids content, and wherein the solids content of the composition is from 0.5 to about 6 weight percent of the total weight of the composition, image conditioning additives, image stability enhancing compounds, such as ultraviolet light absorbing compounds, antioxidants, and the like compounds, and mixtures thereof.

The present invention in embodiments provides a printing machine comprising:

a liquid developer image forming device adapted for forming images on a first substrate, such as known "image transfer paper";

a second substrate adapted for receiving the image from the first substrate;

a coater adapted for overcoating the resulting image on the second substrate, such as a transparency; and a heater adapted to thermally activate an adhesion promoting compound contained in the liquid developer thereby substantially permanently affixing the image and overcoat to the second substrate.

The heater functions to heat the image and overcoat layer at, for example, from about 110 to about 250° C., for about 0.01 to about 10 seconds.

By way of illustration and background of liquid development and related processes, such as in the aforementioned copending application U.S. Ser. No. 08/963,360, now abandoned (D/97132), the disclosure of which is incorporated by reference herein in its entirety, there is disclosed:

A contact electrostatic printing or imaging apparatus, comprising:

a first movable member for having an electrostatic latent image formed thereon including image areas defined by a first voltage potential and non-image areas defined by a second voltage potential;

a second movable member for having a layer of liquid developing material coated thereon; and a process nip formed by operative engagement of the first movable is member and the second movable member for positioning the layer of liquid developing material in pressure contact with the first movable member, wherein the electrostatic latent image on the first member generates imagewise electric fields across the layer of liquid developing material in the process nip;

the process nip being defined by a nip entrance and a nip exit, wherein the nip and the nip entrance are operative to apply compressive stress forces on the layer of liquid developing material thereat, and the nip exit is operative to apply tensile stress forces to the layer of liquid developing material for causing imagewise separation of the layer of liquid developing material thereat, for creating a developed image corresponding to the electrostatic latent image; and the layer of liquid developing material being defined by a yield stress threshold in a range sufficient to allow the layer of liquid developing material to behave substantially as a solid at the nip entrance and in the nip, while allowing the layer of liquid developing material to behave substantially as a liquid along the image/background interfaces at the nip exit. The disclosure of the aforementioned copending application is incorporated herein by reference in its entirety.

Other suitable printing devices which can be use in accomplishing the present invention include liquid development printing machines which employ either ion charging methods, such as contact electrostatic printing (CEP) or conventional chemical charging methods using additives, and conventional xerographic printing machines.

In liquid developer compositions of the present invention, preferred and particularly preferred adhesion promoting compounds are as recited above and in the working examples below. A preferred first resin is an ethylene vinyl acetate copolymer. Preferred pigments are carbon black, cyan, magenta and yellow. A preferred liquid carrier is a hydrocarbon, for example, an ISOPAR®.

The adhesion-promoting compound of the liquid developer is preferably dispersed or intimately mixed with the resin particles, and which particles are well dispersed in the liquid carrier vehicle. In an alternative embodiment, the adhesion promoting compound can be dispersed in either or both the toner resin and liquid carrier phases.

The present invention provides a printing machine for printing images from liquid developers disclosed herein. The liquid developer housing can be adapted for a variety of printing processes and machines, for example, contact electrostatic printing in an electrostatic liquid developer printing machine device or apparatus.

In embodiments the present invention provides a printing machine comprising a the liquid developer housing, a liquid developer receiver member, an intermediate transfer member, a liquid carrier removal member, and a liquid developer composition comprising: a resin or resins, a colorant, a liquid carrier vehicle, and an adhesion promoting compound as described and illustrated herein.

Liquid developer and related compositions and processes for their preparation are known, reference for example, U.S. Pat. Nos. 5,563,015, 5,565,299, 5,567,564, 5,382,492, 5,714,993, 5,570,173, and 5,612,777, the disclosures of which are incorporated herein by reference in their entirety.

The invention will further be illustrated in the following non limiting Examples, it being understood that these Examples are intended to be illustrative only and that the invention is not intended to be limited to the materials, conditions, process parameters, and the like, recited herein. Parts and percentages are by weight unless otherwise indicated.

EXAMPLE IA

PREPARATION OF CYAN LIQUID DEVELOPER WITH AN ADHESION PROMOTING COMPOUND

One hundred and eight (108.0) grams of ELVAX200W®, a copolymer of ethylene and vinyl acetate with a melt index at 190° C. of 2,500, available from E.I. Du Pont de Nemours & Company, Wilmington, Del., 27.0 grams of adhesion promoting resin BYNEL E418®, available from E.I. Du Pont de Nemours & Company, Wilmington, Del., 0 grams of charge control additive, 135.0 grams of the cyan pigment PV Fast Blue B2GA obtained from Clariant, and 405 grams of ISOPAR-G® (Exxon Corporation) were added to a Union Process 1S attritor, available from Union Process Company, Akron, Ohio, charged with 0.1857 inch (4.76 millimeters) diameter carbon steel balls. The mixture was milled in the attritor, which was heated with running steam through the attritor jacket at 56° C. to 115° C. for 2 hours. About 675 grams of ISOPAR-G® (Exxon Corporation) were added to the attritor, and cooled to 23° C. by running water through the attritor jacket, and the contents of the attritor were ground for 4 hours. Additional ISOPAR-G®, about 300 grams, was added and the mixture was separated from the steel balls.

To a one-hundred gram sample of the above toner discharged from attritor (15.0 percent solids) was added 7.0 grams of Alohas charge director (3 weight percent in ISOPAR-G®) and 393.0 grams ISOPAR-G® to provide a charge director level of 14.0 milligrams of charge director per gram of toner solids and 3 weight percent solids based on the total weight of the liquid developer. Alohas is hydroxy bis (3,5-di-tertiary butyl salicyclic) aluminate monohydrate compound, reference for example U.S. Pat. Nos. 5,366,840 and 5,324,613, the disclosures of which are totally incorporated herein by reference.

The resulting charged liquid developer was comprised of toner solids containing 40 weight percent resin, 10 weight percent adhesion promoting resin, 0 weight percent charge control additive, and 50 weight percent pigment based on the total toner solids, ISOPAR-G®, and Alohas charge director which chemically charges the toner positively.

COMPARATIVE EXAMPLE IA

PREPARATION OF LIQUID DEVELOPER WITHOUT AN ADHESION PROMOTING COMPOUND

Example I was repeated with the exception that the aforementioned was adhesion promoting compound omitted from the formulation with the result that the resulting laminated images formed with this developer produced images that possessed considerable and unsatisfactory image defects and laminate instability. The resulting charged liquid developer was comprised of toner solids containing 50 weight percent resin, 0 weight percent adhesion promoting resin, 0 weight percent charge control additive, and 50 weight percent pigment based on the total toner solids, ISOPAR-G®, and Alohas charge director which chemically charges the toner positively.

EXAMPLE IB

PREPARATION OF MAGENTA LIQUID DEVELOPER WITH AN ADHESION PROMOTING COMPOUND

Ninety four point five (94.5) grams of ELVAX 200W®, a copolymer of ethylene and vinyl acetate with a melt index at 190° C. of 2,500, available from E.I. Du Pont de Nemours & Company, Wilmington, Del., 27.0 grams of adhesion promoting resin BYNEL E418®, available from E.I. Du Pont de Nemours & Company, Wilmington, Del., 13.5 grams of charge control additive PLURONIC® F108, available from BASF Specialty Chemicals, 135 grams of the magenta pigment Pigment Red 122 (Sunfast Magenta) available from Sun Chemical, and 405 grams of ISOPAR-G® (Exxon Corporation) were added to a Union Process 1S attritor (Union Process Company, Akron, Ohio) charged with 0.1857 inch (4.76 millimeters) diameter carbon steel balls. The mixture was milled in the attritor, which was heated with running steam through the attritor jacket at 56° C. to 115° C. for 2 hours. About 675 grams of ISOPAR-G® (Exxon Corporation) were added to the attritor, and cooled to 23° C. by running water through the attritor jacket, and the contents of the attritor were ground for 4 hours. Additional ISOPAR-G®, about 300 grams, was added and the mixture was separated from the steel balls.

To a one-hundred gram sample of the above toner discharged from attritor (15.0 percent solids) was added 2.5 grams of Alohas charge director (3 weight percent in ISOPAR-G®) and 397.5 grams ISOPAR-G® to provide a charge director level of 5.0 milligrams of charge director per gram of toner solids, and 3 weight percent solids based on the total weight of the liquid developer. Alohas is the aforementioned aluminate. PLURONIC® F108 is a charge control additive comprised of a poly(ethylene oxide):poly (propylene oxide) block copolymer, reference for example U.S. Pat. No. 5,866,292, the disclosures of which are totally incorporated herein by reference.

The resulting charged liquid developer was comprised of toner solids containing 35 weight percent resin, 10 weight percent adhesion promoting resin, and 50 weight percent pigment based on the total toner solids, 5 weight percent charge control additive, ISOPAR-G®, and Alohas charge director which chemically charges the toner positively.

COMPARATIVE EXAMPLE IB

PREPARATION OF MAGENTA LIQUID DEVELOPER WITHOUT AN ADHESION PROMOTING COMPOUND

Example IB was repeated with the exception that the aforementioned adhesion promoting compound was omitted from the formulation with the result that the resulting laminated images formed with this developer produced images that possessed considerable and unsatisfactory image defects and laminate instability. The resulting charged liquid developer was comprised of toner solids containing 45 weight percent resin, 0 weight percent adhesion promoting resin, 5 weight percent charge control additive, and 50 weight percent pigment (based on the total toner solids), ISOPAR-G®, and Alohas charge director which chemically charges the toner positively.

EXAMPLE IC

PREPARATION OF YELLOW LIQUID DEVELOPER WITH AN ADHESION PROMOTING COMPOUND

Ninety four point five (94.5) grams of ELVAX 200W®, a copolymer of ethylene and vinyl acetate with a melt index at 190° C. of 2,500, available from E.I. Du Pont de Nemours & Company, Wilmington, Del., 27.0 grams of adhesion promoting resin BYNEL E418® available from E.I. Du Pont de Nemours & Company, Wilmington, Del., 13.5 grams of charge control additive, PLURONIC® F108 (BASF Specialty Chemicals), 135 grams of the yellow pigment (Pigment Yellow 155) available from Clariant, and 405 grams of ISOPAR-L® (Exxon Corporation) were added to a Union Process 1S attritor (Union Process Company, Akron, Ohio) charged with 0.1857 inch (4.76 millimeters) diameter carbon steel balls. The mixture was milled in the attritor, which was heated with running steam through the attritor jacket at 56° C. to 115° C. for 2 hours. About 675 grams of ISOPAR-G® (Exxon Corporation) were added to the attritor, and cooled to 23° C. by running water through the attritor jacket, and the contents of the attritor were ground for 4 hours. Additional ISOPAR-G®, about 300 grams, was added and the mixture was separated from the steel balls.

To a one-hundred gram sample of the above toner discharged from attritor (16.3 percent solids) was added 1.36 gram of Alohas charge director (3 weight percent in ISOPAR-G®), and 441.7 grams ISOPAR-G® to provide a charge director level of 2.5 milligrams of charge director per gram of toner solids and 3 weight percent solids based on the total weight of the liquid developer. Alohas is the aforementioned aluminate. PLURONIC® F108 is a charge control additive comprised of a poly(ethylene oxide):poly (propylene oxide) block copolymer, reference for example U.S. Pat. No. 5,866,292, the disclosures of which are totally incorporated herein by reference.

The resulting charged liquid developer was comprised of toner solids containing 35 weight percent resin, 10 weight percent adhesion promoting resin, and 50 weight percent pigment based on the total toner solids, 5 weight percent charge control additive, ISOPAR-G®, and Alohas charge director which chemically charges the toner positively.

COMPARATIVE EXAMPLE IC

PREPARATION OF YELLOW LIQUID DEVELOPER WITHOUT AN ADHESION PROMOTING COMPOUND

Example IC was repeated with the exception that the aforementioned adhesion promoting compound was omitted from the formulation with the result that the resulting laminated images formed with this developer produced images that possessed considerable and unsatisfactory image defects and laminate instability. The resulting charged liquid developer was comprised of toner solids containing 45 weight percent resin, 0 weight percent adhesion promoting resin, 5 weight percent charge control additive, and 50 weight percent pigment based on the total toner solids, ISOPAR-G®, and Alohas charge director mixture which chemically charges the toner positively.

EXAMPLE ID

PREPARATION OF BLACK LIQUID DEVELOPER WITH AN ADHESION PROMOTING COMPOUND

Ninety seven point two (97.2) grams of ELVAX 200W®, a copolymer of ethylene and vinyl acetate with a melt index at 190° C. of 2,500, available from E.I. Du Pont de Nemours & Company, Wilmington, Del., 27.0 grams of adhesion promoting resin BYNEL E418®, available from E.I. Du Pont de Nemours & Company, Wilmington, Del., 40.5 grams of the carbon black (Black Pearls L, available from Cabot), and 105.3 grams of the process black, a cyan/magenta/yellow pigment mixture comprised of 38.6 grams of the cyan pigment (PV Fast Blue from Clariant), 35.1 grams of the magenta pigment (Rhodamine Y from Sun Chemical), 31.6 grams of the yellow pigment (Pigment Yellow 17 from Sun Chemical), 0 grams of charge control additive, and 405 grams of ISOPAR-G® (Exxon Corporation) were added to a Union Process 1S attritor (Union Process Company, Akron, Ohio) charged with 0.1857 inch (4.76 millimeters) diameter carbon steel balls. The mixture was milled in the attritor, which was heated with running steam through the attritor jacket at 56° C. to 115° C. for 2 hours. About 675 grams of ISOPAR-G® (Exxon Corporation) were added to the attritor, and cooled to 23° C. by running water through the attritor jacket, and the contents of the attritor were ground for 4 hours. Additional ISOPAR-G®, about 300 grams, was added and the mixture was separated from the steel balls.

To a one-hundred gram sample of the above toner discharged from attritor (15.0 percent solids) was added 10.0 grams of the 1:1 weight ratio mixture of Alohas and PS900 charge directors (3 weight percent in ISOPAR-G®), and 390.0 grams ISOPAR-G® to provide a charge director level of 20.0 milligrams of charge director per gram of toner solids and 3 weight percent solids based on the total weight of the liquid developer. The mixture of Alohas and PS900 is a mixed charge director composition; PS900 is a non-polar liquid soluble organic phosphate mono- and di-ester mixture derived from phosphoric acid and isotridecyl alcohol, available from Witco, reference for example U.S. Pat. Nos. 5,783,349 and 5,866,292 the disclosures of which are totally incorporated herein by reference, and Alohas is the aforementioned hydroxy aluminate compound.

The resulting charged liquid developer was comprised of toner solids containing 36 weight percent resin, 10 weight percent adhesion promoting resin, 0 weight percent charge control additive, and 54 weight percent pigment mixture based on the total toner solids, ISOPAR-G®, and Alohas/PS900 charge director which chemically charges the toner positively.

COMPARATIVE EXAMPLE ID

PREPARATION OF BLACK LIQUID DEVELOPER WITHOUT AN ADHESION PROMOTING COMPOUND

Example ID was repeated with the exception that the aforementioned was adhesion promoting compound omitted from the formulation with the result that the resulting laminated images formed with this developer produced images that possessed considerable and unsatisfactory image defects and laminate instability. The resulting charged liquid developer was comprised of toner solids containing 46 weight percent resin, 0 weight percent adhesion promoting resin, 0 weight percent charge control additive, and 54 weight percent pigment mixture based on the total toner solids, ISOPAR-G®, and Alohas/PS900 charge director mixture which chemically charges the toner positively.

EXAMPLE II

LIQUID DEVELOPMENT AND LAMINATION PROCESS WITH LIQUID DEVELOPER CONTAINING ADHESION PROMOTING COMPOUND

The cyan, magenta, yellow and black liquid developers respectively prepared in Examples IA, IB, IC and ID above were used in an liquid development process as in the Xerox 8954 Series II wide format color printer. The color bar liquid toner images were first developed and self-fixed on an Image Transfer Wearcoat paper (Xerox Part No. 23R870). The images were then transferred from the Wearcoat paper to a receiver stock ETM 1002 or ETM 2002, and laminated with over-laminate DOL 1000 or DOL 2000. The lamination was carried out using an ORCA III laminator (Seal Inc.). The results are summarized in Table 1 below.

COMPARATIVE EXAMPLE II

LIQUID DEVELOPMENT PROCESS WITH LIQUID DEVELOPER WITHOUT ADHESION PROMOTING COMPOUND

The cyan, magenta, yellow and black liquid developers respectively prepared in Comparative Example IA, IB, IC, and ID were used in an liquid development process in accordance with the liquid development process of Example II with the exception that the liquid developers were free of adhesion promoting compound. The results are summarized in Table 1 below.

Printing a First Image on a First Substrate with Liquid Toners

Cyan, magenta, yellow, black, red, green, blue and 3-color black color bar (52"×3") images, as referred to in the first column of Table 1, were printed on the first Image Transfer Wearcoat paper (Xerox Part No. 2R870) with the liquid developers respectively prepared in Examples IA, IB, IC and ID, or in Comparative Examples IA, IB, IC and ID using a modified Xerox ColorgrafX Systems (XCGS) Model 8954 color printer. The red, green, and blue color bars were generated by yellow over magenta, yellow over cyan, and magenta over cyan, respectively. The 3-color black was the overlay of cyan, magenta and yellow images respectively. The printer produces color or monochrome images on various types of media, including opaque paper, presentation paper, outdoor media, and clear or matte-finish polyester film. In the present invention the aforementioned Image Transfer Wearcoat paper was used so that the image could be subsequently transferred to a second substrate.

The print media can be a continuous web, for example, dispensed from a supply roll, and can be coated with a dielectric and a conductive layer. The media web passes between a back-plate electrode and a writing head. The writing head contains an array of writing nibs, for example, 200 nibs/inch. The writing head and the back-plate electrode create negative charges on the media web as it passes between the electrode and the head. For each scan line of output, only writing nibs corresponding to rasterized data charge the media web.

The media web then passes over a series of rotary liquid ink fountains, for example, Yellow, Black, Cyan, and Magenta, respectively, which are reversibly engaged with the media web. The inks are a suspension of positively charged ink particles, for example, as prepared in Examples IA, IB, IC, and ID, or Comparative Examples IA, IB, IC, and ID. The ink fountain is a mechanical assembly that applies ink to the media web. Ink contacts the media and an image is developed in negatively charged areas on the media web. This is an example of typical charge area development (CAD) of liquid ink.

Ink deposited in the uncharged areas of the media web output leaves is a thin film. The surface of the fountain roller moves in the opposite direction from the motion of the media and mechanically removes this film from media. Removing the undeveloped ink from the media leaves the output image. The output image is relatively stable because the electrostatic attraction of positive ink particles to the negatively charged media web surface is greater than the reverse metering shear of the fountain roller. Drying fans can be employed to circulate air over the output image, making it smudge resistant by removing ISOPAR-G® from the image and the background areas.

Monochrome output can be produced in a single pass, while a multiple-pass technique is used for color output. For example, there can be 4-pass, 5-pass, and 6-pass media modes. The 4-pass mode combines the registration pass with the black pass, printing both registration marks and the black image information at the same time. The three subsequent passes print the cyan, magenta, and yellow color information. The 5-pass mode first prints the registration marks, followed by the 4-pass color information. The 6-pass mode uses the first pass to condition the media to the ambient temperature and humidity conditions without charging or toning at all. After rewinding, the remaining passes are the same as a 5-pass mode. The color bar prints on the Image Transfer Wearcoat paper were formed using the 4-pass mode.

The XCGS 8954 printer was modified for use with the liquid developers prepared in Examples I and Comparative Examples I in order to eliminate over-plating or contamination of undesirable color on the previously printed colors, reference for example U.S. Pat. No. 5,848,337, the disclosure of which is totally incorporated herein by reference.

Transferring the Image from the First Substrate to a Second Substrate

The color bars printed on Image Transfer Wearcoat paper—the first substrate were subsequently transferred to a receiver stock—a second substrate, using a heat and pressure assisted transfer. Two types of receiver stock were used: ETM 1002 and ETM 2002 plastic sheets.

Laminating the image on the Second Substrate

The color bars on the second substrate were then over-laminated with a clear laminate by using an ORCA III laminator (Seal, Inc.). Two types of over-laminate were used: DOL 1000 and DOL 2000. The DOL 1000 utilizes a solvent-based permanent acrylic adhesive; DOL 2000 utilizes an emulsion-based permanent acrylic adhesive. The lamination was achieved by passing the image on the second substrate and the overlaminate through the ORCA III laminator at a speed of 1.5 or 2.5 inches per second. The laminator engages a pair of heated top and bottom rolls with conformable coatings with pistons activated by compressed air. The temperatures of the top and bottom rolls were 250 and 180° C., respectively. The pressure of the compressed air was 90 psi. The heated top/bottom rolls were adapted as a heater to thermally activate the adhesion-promoting compound contained in the liquid developer thereby substantially permanently affixing the image and overcoat to the second substrate.

Adhesion Force Measurement

The adhesion force for the laminated color bars was then determined using ASTM D 1876-95 Test Method for peel resistance (T-Peel Test). Several tests were carried out for each color bar to obtain an average value of the peel force. The adhesion force values contained in Table 1 were average values calculated from a total of eight values for each color; two receiver stocks x two over-laminates x two lamination speed produced eight combinations.

TABLE 1

Adhesion Forces for Examples II and Comparative Examples II

| Color Bar | Adhesion Force (lb./in) (Example II) | Adhesion Force (lb./in) (Comp. Example II) | % Increase in Adhesion Force |
|---|---|---|---|
| Cyan | 2.71 | 2.59 | 4.80 |
| Magenta | 2.89 | 2.05 | 40.9 |
| Yellow | 3.50 | 2.73 | 28.4 |
| Black | 2.78 | 2.28 | 22.0 |
| Red | 2.89 | 2.08 | 39.2 |
| Green | 2.86 | 2.16 | 32.4 |
| Blue | 2.49 | 1.94 | 28.4 |
| 3-color Black | 2.59 | 2.05 | 26.2 |

The adhesion force averages for Example II were the results from the cyan, magenta, yellow and black liquid developers containing 10 weight percent adhesion-promoting compound of the developer solid, which were respectively prepared in Examples IA, IB, IC and ID. Adhesion forces for Comparative Example II were the results from the cyan, magenta, yellow and black liquid developers without adhesion-promoting compound, which were respectively prepared in Comparative Examples IA, IB, IC and ID. The calculated percent increase in adhesion force is defined as: (the adhesion force in Example II minus the adhesion force in Comparative Example II) divided by the adhesion force in Comparative Example II multiplied by 100. Overall, the images containing adhesion-promoting compound exhibit a superior performance over those without adhesion-promoting compound.

Other modifications of the present invention may occur to one of ordinary skill in the art based upon a review of the present application and these modifications, including equivalents thereof, are intended to be included within the scope of the present invention.

What is claimed is:

1. A liquid toner comprising: a first resin, a second adhesion promoting resin, a colorant, and a carrier liquid, wherein the second adhesion promoting resin promotes the adhesion of developed toner images to: a substrate, to a transparent overcoat layer, and to adjacent toner layers.

2. A liquid toner in accordance with claim 1, wherein the second adhesion promoting resin is a thermally activated polymer composition selected from the group consisting of epoxy-modified ethylene vinyl acetate copolymers, anhydride-modified ethylene vinyl acetate copolymers, ethylene methacrylic acid copolymers, ethylene acrylic acid copolymers, ethylene-vinyl acetate-methacrylic acid terpolymers, copolymers thereof, and mixtures thereof.

3. A liquid toner in accordance with claim 1, wherein the first resin is present in a major amount of from about 5 to about 80 weight percent, and wherein the second adhesion promoting resin is present in an amount of from about 1.0 to about 35 weight percent based on the total solids content of the liquid toner.

4. A liquid toner in accordance with claim 1, wherein said first resin is selected from the group consisting of acrylates, styrenes, polyesters, polyolefins, copolyolefins, copolymers of olefins and acylated vinyl alcohols, copolymers of olefins and acrylic acids, copolymers of olefins and alkylated acrylic acids, and mixtures thereof.

5. A liquid toner in accordance with claim 1, wherein the colorant is selected from the group consisting of pigments, dyes, and mixtures thereof.

6. A liquid toner in accordance with claim 1, wherein the carrier liquid is selected from the group consisting of linear hydrocarbons with from 10 to about 40 carbon atoms, branched hydrocarbons with from 10 to about 40 carbon atoms, and mixtures thereof.

7. A liquid toner in accordance with claim 1, wherein the liquid developer further comprises optional additives selected from the group consisting of charge directing compounds, charge control additives, image conditioning additives, image stability enhancing compounds, and mixtures thereof.

* * * * *